US006886899B2

(12) United States Patent
Kuwahara

(10) Patent No.: US 6,886,899 B2
(45) Date of Patent: May 3, 2005

(54) PRINTER HEAD, PRINTER, AND PRINTER-HEAD DRIVING METHOD

(75) Inventor: Soichi Kuwahara, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/837,056

(22) Filed: Apr. 29, 2004

(65) Prior Publication Data

US 2004/0201643 A1 Oct. 14, 2004

Related U.S. Application Data

(63) Continuation of application No. 10/086,901, filed on Mar. 1, 2002, now Pat. No. 6,764,164.

(30) Foreign Application Priority Data

Mar. 6, 2001 (JP) ..... P2001-061887

(51) Int. Cl.[7] ..... B41J 29/38; B41J 2/155
(52) U.S. Cl. ..... 347/13; 347/42
(58) Field of Search ..... 347/40, 42, 9, 347/12, 13

(56) References Cited

U.S. PATENT DOCUMENTS 5,384,587 A 1/1995 Takagi et al. ..... 346/140
5,818,478 A 10/1998 Gibson
6,027,203 A * 2/2000 Campbell ..... 347/42
6,394,579 B1 * 5/2002 Boyd et al. ..... 347/47

FOREIGN PATENT DOCUMENTS

| | | |
|---|---|---|
| EP | 0707965 | 4/1996 |
| EP | 0755791 | 1/1997 |
| EP | 0968832 | 1/2000 |
| GB | 2353499 | 2/2001 |

* cited by examiner

*Primary Examiner*—Thinh Nguyen
(74) *Attorney, Agent, or Firm*—Sonnenschein, Nath & Rosenthal LLP

(57) ABSTRACT

In a line-type printer head, a plurality of head chips are arranged side by side in a printing direction, and each of the head chips has a plurality of discharging portions aligned in the printing line direction so as to discharge ink droplets. A plurality of discharging portions of the adjoining head chips are placed in an overlapping section, and the landing interval between ink droplets discharged from the discharging portions in the overlapping section of one of the adjoining head chips and the landing interval between ink droplets discharged from the discharging portions in the overlapping section of the other head chip are different from each other.

40 Claims, 11 Drawing Sheets

PRINTER HEAD, PRINTER, AND PRINTER-HEAD DRIVING METHOD

RELATED APPLICATION DATA

The present application is a continuation of U.S. application Ser. No. 10/086,901, filed Mar. 1, 2002 now U.S. Pat. No. 6,764,164. The present and foregoing applications claim priority to Japanese Application No. P2001-061887, filed Mar. 6, 2001. All of the foregoing applications are incorporated herein by reference to the extent permitted by law.

BACKGROUND OF THE INVENTION

1. Field of the Invention

The present invention relates to a printer head used in a thermal ink-jet line printer and the like, a printer having the printer head, and a driving method for the printer head.

2. Description of the Related Art

FIG. 11 shows an example of a printer head in a known thermal ink-jet line printer. In the line printer, since one line is printed on a printing object at a time, a plurality of head chips 1 (1A, 1B, . . . ) are arranged side by side in the printing line direction. While only two head chips 1A and 1B are shown in FIG. 11, the plurality of head chips 1 are arranged side by side in the right and left direction of the figure.

The adjoining head chips 1 are placed offset from each other in the vertical direction. This is because an ink channel is formed between the upper head chip 1A and the lower head chip 1B in FIG. 11. These upper and lower head chips 1A and 1B perform discharging while shifting the discharge timing so that printed dots are arranged in a line.

Each head chip 1 has a plurality of discharging portions. The discharging portions are aligned in the printing line direction, and are arranged at predetermined intervals, as shown in FIG. 11. In the example shown in FIG. 11, the interval between the discharging portions is L. This also applies to all the head chips 1.

As shown in FIG. 11, the right-end discharging portion of the head chip 1A and the left-end discharging portion of the head chip 1B which adjoins the head chip 1A are placed with an interval L therebetween in the printing line direction. This allows all the ink droplets to land on a printing object at the intervals L even when the ink droplets are printed by using a plurality of head chips 1.

However, ink does not land on the initially designed positions due to the positional accuracy of the head chips 1, the positional accuracy for mounting heaters (not shown) which heat and discharge ink droplets, the positional accuracy of nozzles 2, or the like. In particular, the characteristics may greatly vary among the head chips 1. For this reason, the pitch between ink droplets which land on a printing object varies among the head chips 1.

This problem is marked particularly when the position of the heater and the position of the nozzle 2 are offset from each other. While the influence of the offset on the landing position varies depending on the structure of the discharging portion and the like, even when the center position of the heater and the center position of the nozzle 2 are offset by only 1 $\mu$m, the discharging direction is sometimes tilted 0.2 degrees.

In this case, when the discharging portion and the printing object are placed with a gap of 2 mm therebetween, the dot landing position is displaced by 7 $\mu$m from the normal position. Therefore, for example, even when the heaters are placed at the normal positions, and the positions of the nozzles 2 are displaced by −1 $\mu$m from the normal positions in the direction of arrangement of the discharging portions in one head chip 1, and are displaced by +1 $\mu$m from the normal positions in the direction of arrangement of the discharging portions on the other head chip 1, the landing position on the printing object at a distance of 2 mm from the discharging portion is displaced by −7 $\mu$m from the normal position in one head chip, and is displaced by +7 $\mu$m in the other head chip. Therefore, the interval is increased to a total of 14 $\mu$m.

FIGS. 12A to 12C show states in which ink droplets are discharged onto the printing object. In these figures, black circles in the left half represent ink droplets printed by the head chip 1A, and white circles in the right half represent ink droplets printed by the head chip 1B.

FIG. 12A shows a state in which there is no relative difference in landing position between the head chips 1A and 1B. In the case shown in FIG. 12A, the interval between the landing position of the right-end ink droplet from the head chip 1A and the landing position of the left-end ink droplet from the head chip 1B is substantially equal to the interval L of the ink-droplet landing positions in each head chip 1, and banding does not occur at the boundary therebetween.

In contrast, FIGS. 12B and 12C show examples in which there is a relative difference in landing position between the head chips 1A and 1B. FIG. 12B shows a state in which the landing interval between the head chips 1A and 1B is longer than L, and FIG. 12C shows a state in which the landing interval between the head chips 1A and 1B is shorter than L.

Consequently, the relative difference in landing position between the head chips 1A and 1B appears as a white band in FIG. 12B, and as a black band in FIG. 12C.

In order to prevent such differences in landing position between the head chips 1, the mounting accuracy of the nozzles 2 and the heaters is increased. However, there are limitations on increasing the accuracy.

SUMMARY OF THE INVENTION

Accordingly, an object of the present invention is to make banding, which occurs due to a difference in landing position between head chips arranged side by side in a printer head, unnoticeable.

In the present invention, a plurality of discharging portions of the adjoining first and second head chips are placed so as to overlap with each other. The landing interval of ink droplets in the overlapping section of the first head chip and the landing interval of ink droplets in the overlapping section of the second head chip are different from each other.

Therefore, by switching from the landing of ink droplets from the first head chip to the landing of ink droplets from the second head chip at a position where the interval between a specific ink droplet in the overlapping section of the first head chip and a specific ink droplet in the overlapping section of the second head chip is closest to the normal interval, the boundary between ink droplets discharged from the head chips can be made unnoticeable.

Further objects, features and advantages of the present invention will become apparent from the following description of the preferred embodiments with reference to the attached drawings.

DESCRIPTION OF THE PREFERRED EMBODIMENTS

Figure 1A:
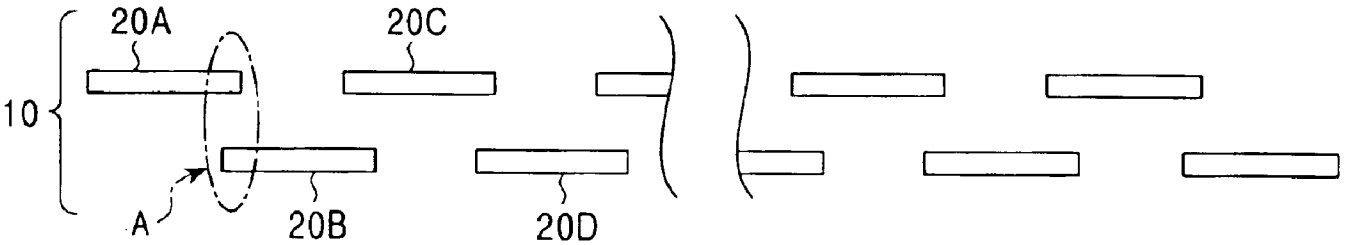
FIG. 1A is a plan view of a printer head according to an embodiment of the present invention.

An embodiment of the present invention will be described below with reference to the attached drawings. FIG. 1A is a plan view of a printer head according to an embodiment of the present invention.

A printer head 10 is applied to a thermal ink-jet line printer.

In the printer head 10, a plurality of head chips 20 (20A, 20B, . . . ) are arranged side by side in a printing line direction, and the adjoining head chips 20 are placed offset from each other in the vertical direction by a predetermined distance. This is because an ink channel (not shown) is formed between a head chip 20 disposed on the upper side and a head chip 20 disposed on the lower side, and ink is supplied to the head chips 20 via the ink channel.

Figure 1B:
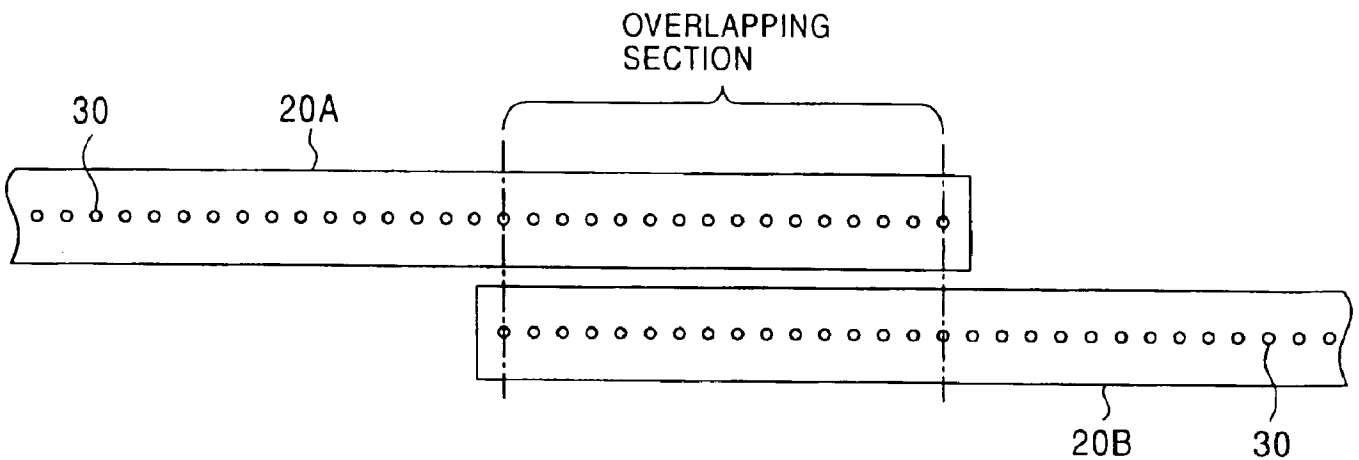
FIG. 1B is an enlarged view of an A-section in FIG. 1A.

FIG. 1B is an enlarged view of an A-section in FIG. 1A. As shown in FIG. 1B, discharging portions 30 for discharging ink droplets are aligned in each head chip 20. A plurality of discharging portions 30 of the adjoining head chips 20 overlap in the printing line direction. Hereinafter, this section will be referred to as an "overlapping section".

In the example shown in FIG. 1B, sixteen discharging portions 30 of the head chip 20A and sixteen discharging portions 30 of the head chip 20B are placed in the overlapping section.

Figure 2:
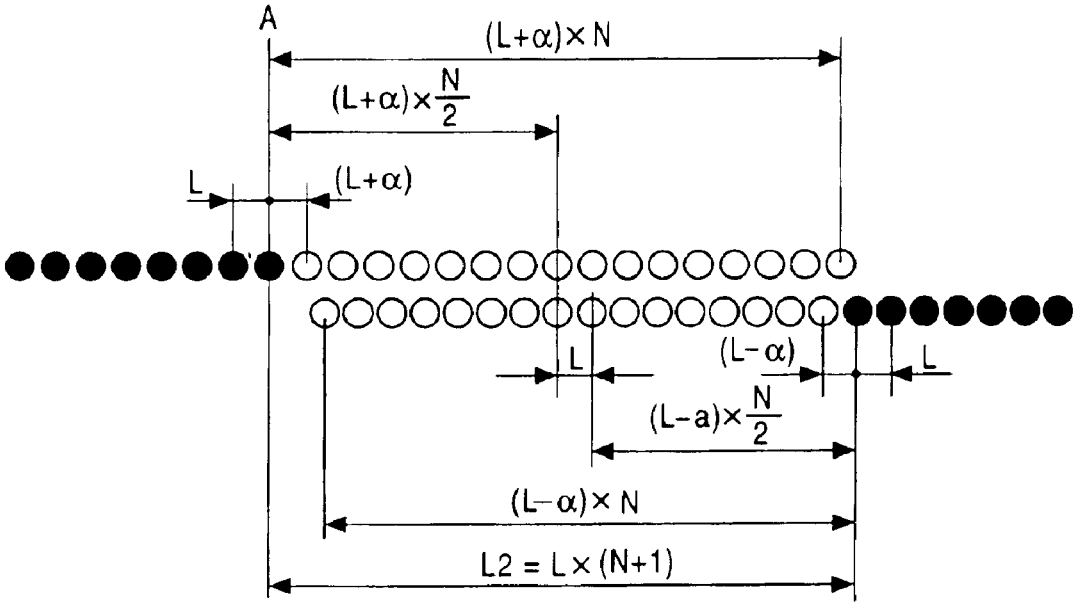
FIG. 2 is a plan view showing a state in which ink droplets are discharged from discharging portions of the adjoining head chips adjacent to overlapping sections, and land on a printing object.

FIG. 2 is a plan view showing a state in which ink droplets are discharged from the discharging portions 30 of the adjoining head chips 20 adjacent to the overlapping section, and land on a printing object. In the figure, black circles represent droplets discharged from the discharging portions 30 outside the overlapping section, and white circles represent droplets discharged from the discharging portions 30 inside the overlapping section.

In FIG. 2, the landing intervals of ink droplets outside the overlapping section are designated L. In this case, the landing interval in the upper overlapping section is set to be $(L+\alpha)$. In contrast, the landing interval in the lower overlapping section is set to be $(L-\alpha)$.

That is, the landing interval between ink droplets in the upper overlapping section is set to be longer by $\alpha$ than the landing interval between ink droplets outside the overlapping sections. In contrast, the landing interval between ink droplets in the lower overlapping section is set to be shorter by $\alpha$ than the landing interval between ink droplets outside the overlapping sections.

When the number of the discharging portions 30 in each overlapping section is designated N (sixteen in FIG. 2), the total length of the upper overlapping section is $(L+\alpha)\times N$, and that of the lower overlapping section is $(L-\alpha)\times N$.

In FIG. 2, L2 is set to be $L\times(N+1)$. As a result, at the midpoints of the overlapping sections, the landing interval in the printing line direction between the upper landing position and the lower landing position is set to be equal to L, which is the landing interval outside the overlapping sections.

That is, the interval between a droplet positioned at a distance of $(L+\alpha)\times N/2$ from the left in the upper overlapping section and a droplet positioned at a distance of $(L-\alpha)\times N/2$ from the right in the lower overlapping section is set to be L.

A method for changing the ink-droplet landing interval in the overlapping section will now be described.

Figure 3:
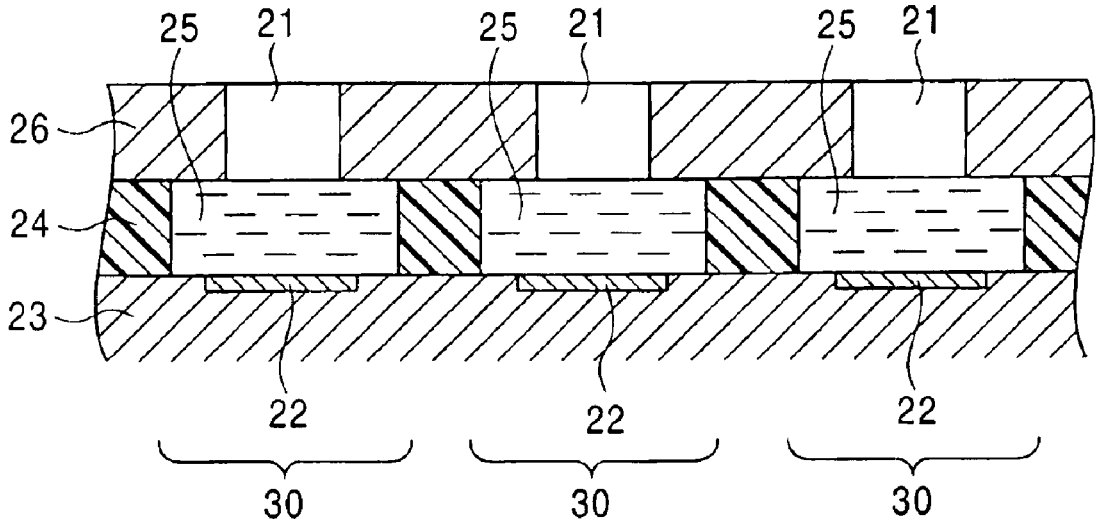
FIG. 3 is a sectional view showing the structure of the discharging portions of the head chip.

FIG. 3 is a sectional view showing the structure of the discharging portions 30 of the head chip 20. Three discharging portions 30 are shown in FIG. 3.

In the discharging portions 30, heaters 22 serve to heat ink and are placed on, for example, a silicon substrate 23, and the driving thereof is controlled by a predetermined driving circuit. The heaters 22 and partitions 24 made of, for example, resin are disposed on the substrate 23.

The partitions 24 define ink chambers 25 each having the heater 22. A nozzle sheet 26 having circularly opened nozzles 21 is formed on the partitions 24.

Ink supplied from an ink tank (not shown) to an ink channel (not shown) is guided to the ink chamber 25, and is heated by the heater 22 therein. An ink droplet is discharged from the nozzle 21 by energy of heating.

In the discharging portions 30 outside the overlapping section, the heater 22 and the nozzle sheet 26 are placed relative to each other so that the center line of the heater 22 and the center line of the nozzle 21 coincide with each other. The interval between the center lines is equal to L shown in FIG. 2.

Figure 4A:
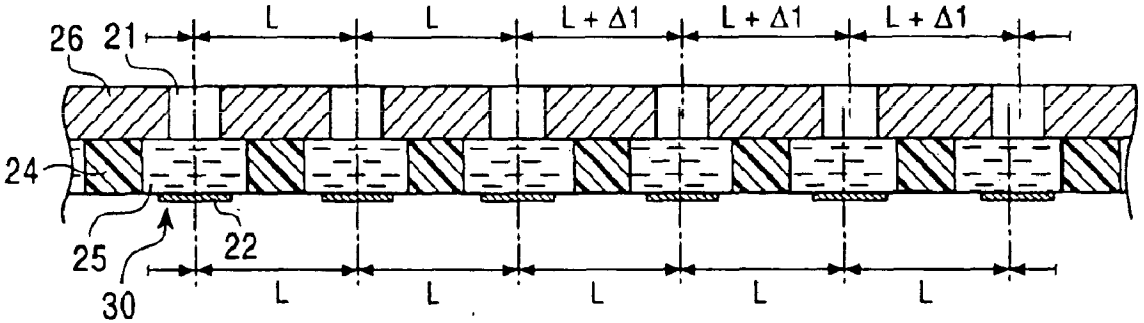
FIGS. 4A to 4C are sectional views showing three different examples of sizes of the discharging portions arranged side by side inside and outside the overlapping section.
Figure 4B:
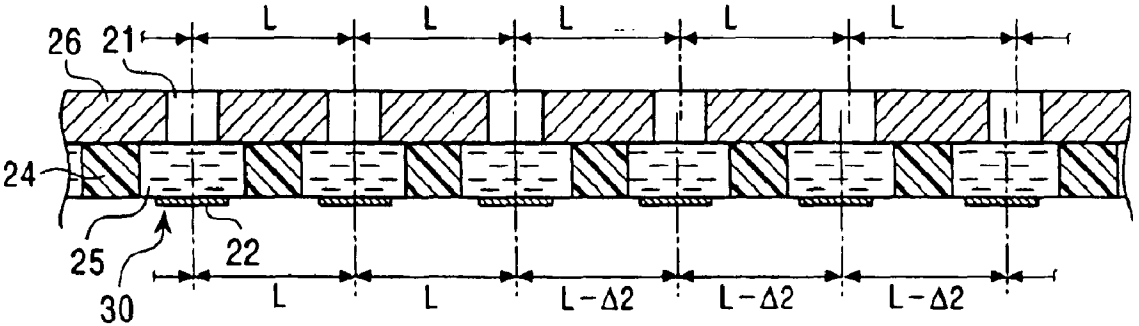
Figure 4C:
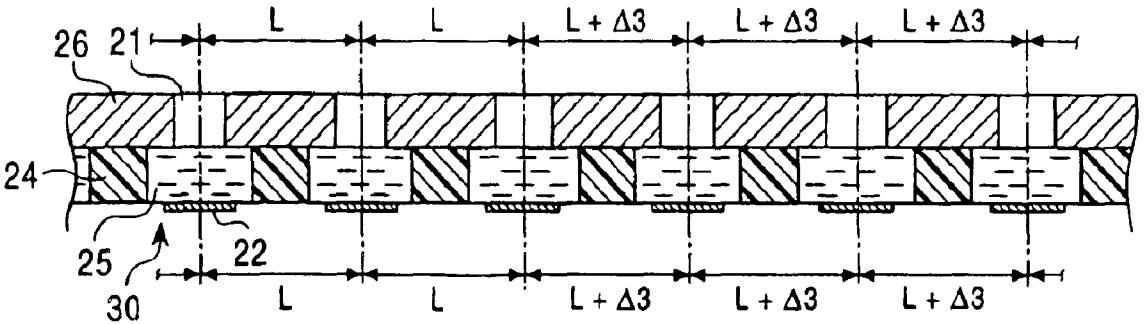

FIGS. 4A to 4C are sectional views showing three different examples of sizes of the discharging portions 30 arranged side by side inside and outside the overlapping section of the head chip 20. In the figures, three left discharging portions 30 represent discharging portions placed outside the overlapping section, and three right discharging portions 30 represent discharging portions within the overlapping section.

First, in the example shown in FIG. 4A, the arrangement interval between the heaters 22 is equally set at L in the overlapping section and outside the overlapping section. The arrangement interval between the nozzles 21 outside the overlapping section is set at L which is equal to the arrangement interval between the heaters 22. In contrast, the arrangement interval between the nozzles 21 in the overlapping section is more than the arrangement interval L between the heaters 22, and is set at (L+Δ1).

In the example shown in FIG. 4B, the arrangement interval between the nozzles 21 is equally set at L in the overlapping section and outside the overlapping section. The arrangement interval between the heaters 22 outside the overlapping section set at L which is equal to the arrangement interval between the nozzles 21. In contrast, the arrangement interval between the heaters 22 in the overlapping section is less than the arrangement interval L between the nozzles 21, and is set at (L−Δ2).

In the example shown in FIG. 4C, both the arrangement interval between the heaters 22 and the arrangement interval between the nozzles 21 outside the overlapping section are set at L. Both the arrangement interval between the heaters 22 and the arrangement interval between the nozzles 21 in the overlapping section are more than those outside the overlapping section, and are set at (L+Δ3).

According to the above, in the examples shown in FIGS. 4A and 4B, the center line of the heater 22 and the center line of the nozzle 21 are disposed offset from each other by a predetermined amount in the overlapping section.

In contrast, in the example shown in FIG. 4C, the center line of the heater 22 and the center line of the nozzle 21 coincide with each other in the overlapping section.

Figure 5B:
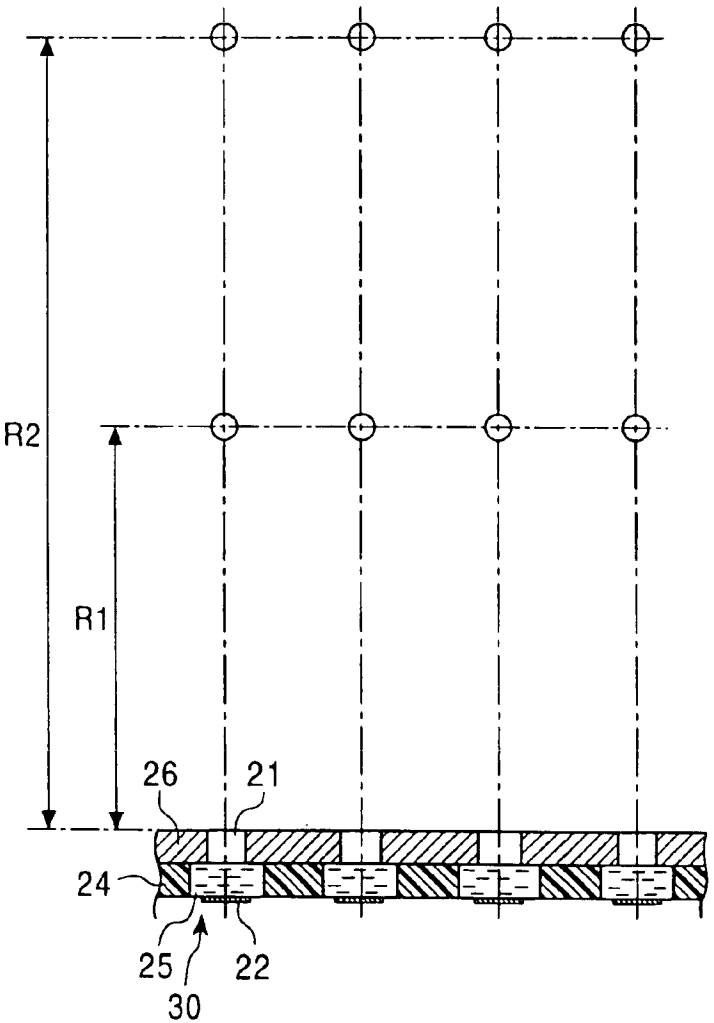
FIGS. 5A and 5B are views showing the paths of discharged ink droplets, respectively, corresponding to FIGS. 4A and 4C.
Figure 5A:
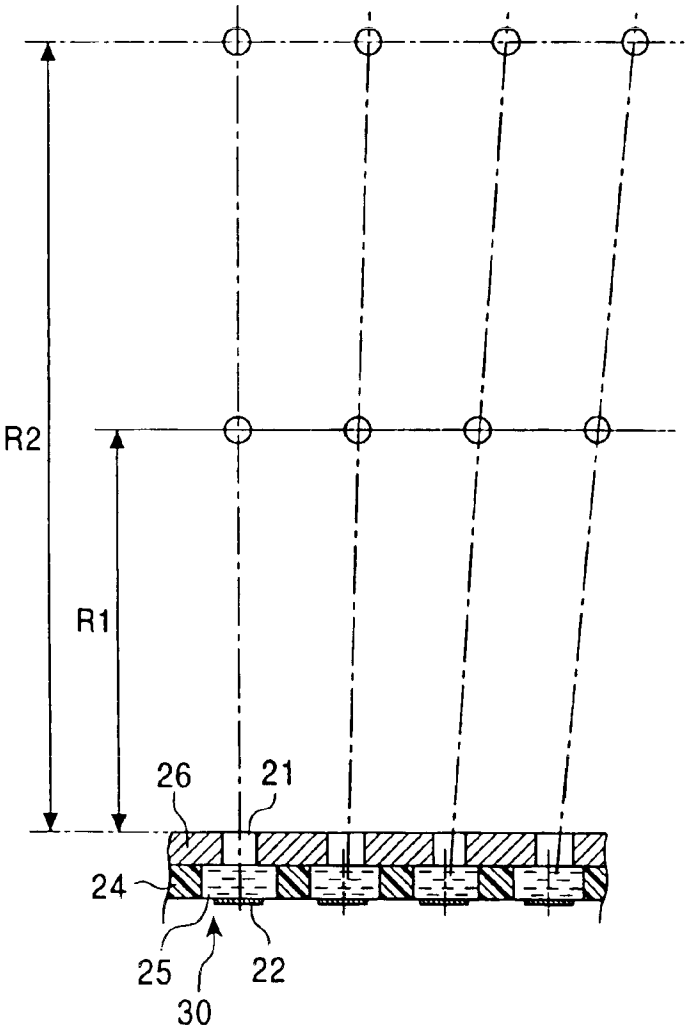

FIGS. 5A and 5B show the paths of discharged ink droplets, respectively, corresponding to FIGS. 4A and 4C.

In the example shown in FIG. 5A, the center line of the nozzle 21 and the center line of the heater 22 do not coincide with each other. For this reason, an ink droplet is discharged while deviating from the center line of the nozzle 21 by a predetermined angle. Therefore, in this case, the amount of deviation of the landing position increases as the gaps R1 and R2 from the ink-droplet discharging position to the printing surface increase. For example, when the gap doubles from R1 to R2, the amount of deviation also doubles.

In contrast, in the example shown in FIG. 5B, since the center line of the nozzle 21 and the center line of the heater 22 coincide, an ink droplet is discharged in parallel with the center line of the nozzle 21. This also applies to cases in which the arrangement intervals between the nozzles 21 and between the heaters 22 are more than and less than those in the overlapping section. Accordingly, in this case, even when the gap changes from R1 to R2, the amount of deviation does not change.

Even in a case in which the interval between the heaters 22 is less than the interval between the nozzles 21 in the overlapping section, as shown in FIG. 4B, an ink droplet is discharged while deviating from the center line of the nozzle 21 by a predetermined angle, in a manner similar to that in FIG. 5A. This also applies to a case in which the interval between the nozzles 21 is more than L and the interval between the heaters 22 is less than L, or a case in which the interval between the nozzles 21 is less than L and the interval between the heaters 22 is more than L.

According to the above, the landing interval of ink droplets in the overlapping section is more than the landing interval outside the overlapping section in the case (1) in which the interval between the heaters 22 is equal inside and outside the overlapping section, and the interval between the nozzles 21 is more than the interval between the heaters 22 in the overlapping section, the case (2) in which the interval between the nozzles 21 is equal inside and outside the overlapping section, and the interval between the heaters 22 is less than the interval between the nozzles 21 in the overlapping section, the case (3) in which the interval between the heaters 22 in the overlapping section is less than the interval outside the overlapping section, and the interval between the nozzles 21 in the overlapping section is more than the interval outside the overlapping section, and the case (4) in which both the intervals between the nozzles 21 and between the heaters 22 in the overlapping section are more than the intervals outside the overlapping section.

Similarly, the landing interval of ink droplets in the overlapping section is less than the landing interval outside the overlapping section in the case (1) in which the interval between the heaters 22 is equal inside and outside the overlapping section, and the interval between the nozzles 21 is less than the interval between the heaters 22 in the overlapping section, the case (2) in which the interval between the nozzles 21 is equal inside and outside the overlapping section, and the interval between the heaters 22 is more than the interval between the nozzles 21 in the overlapping section, the case (3) in which the interval between the heaters 22 in the overlapping section is more than the interval outside the overlapping section, and the interval between the nozzles 21 in the overlapping section is less than the interval outside the overlapping section, and the case (4) in which both the intervals between the nozzles 21 and between the heaters 22 in the overlapping section are less than the intervals outside the overlapping section.

By adopting any of the above cases, the landing interval of ink droplets in the overlapping section of one of the adjoining head chips 20 is increased, and the landing interval of ink droplets in the overlapping section of the other head chip 20 is decreased.

In order to change the interval between the nozzles 21, aperture regions of the nozzles 21 need to be placed within the upper surfaces of the ink chambers 25.

In contrast, in order to change the interval between the heaters 22, the heaters 22 need to be placed inside the ink chambers 25.

Accordingly, when only the interval between the nozzles 21 is changed, when only the interval between the heaters 22 is changed, or when both the intervals between the nozzles 21 and the heaters 22 are changed so that they are different from each other, as shown in FIGS. 4A and 4B, the allowance for positional accuracy of the nozzles 21 and the heaters 22 is decreased. In contrast, when both the interval between the nozzles 21 and the interval between the heaters 22 are changed while the distance between the partitions 24 is fixed, as shown in FIG. 4C, the allowance for positional accuracy of the nozzles 21 and the heaters 22 is equivalent to that outside the overlapping section.

Next, a method for driving the head chips 20 will be described more specifically.

In this embodiment, a pair of adjoining head chips 20 are driven so as to switch between the discharging of ink droplets from one of the head chips 20 and the discharging of ink droplets from the other head chip 20 at a position where the interval in the printing line direction between the landing position of an ink droplet discharged from a specific discharging portion 30 of one of the head chips 20 and the landing position of an ink droplet discharged from a specific discharging portion 30 of the other head chip 20 is closest to the landing interval outside the overlapping section.

This makes it possible to remove a difference in landing position of ink droplets between the head chips 20, or to make the difference unnoticeable.

FIGS. 6A to 6E explain a first embodiment of switching the discharging of ink droplets between the head chips 20. In these figures, ink droplets on the upper side are discharged from one of the adjoining head chips 20, and ink droplets on the lower side are discharged from the other head chip 20.

In FIGS. 6A to 6E, the center positions of the nozzles 21 and the center positions of the heaters 22 are made different from each other in the overlapping sections of the head chips 20 so as to change the ink-droplet landing intervals.

Figures 6A, 6B, 6C, 6D, 6E:
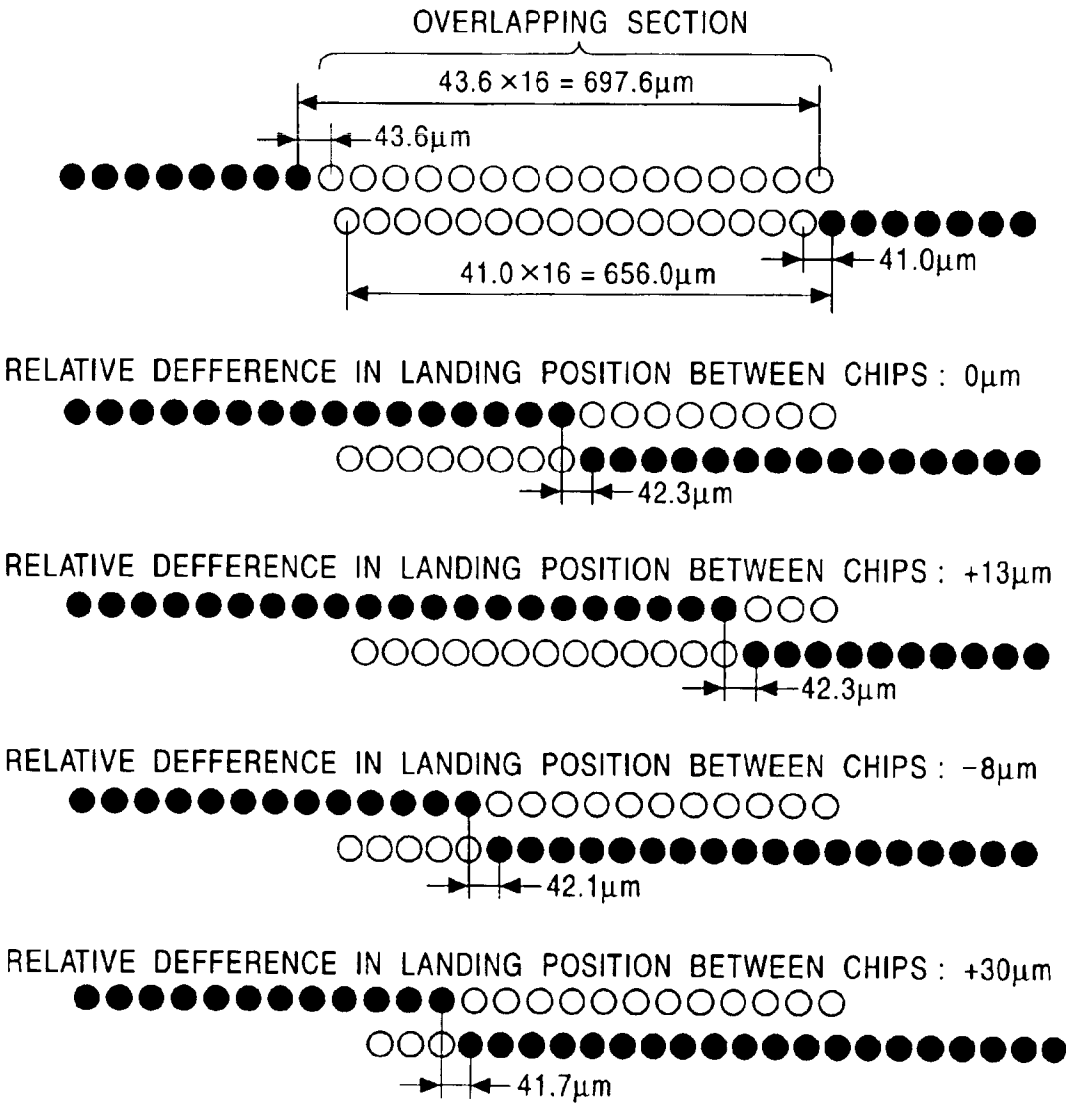
FIGS. 6A to 6E are views explaining a first embodiment of the switching the discharging of the ink droplets between the head chips.

FIG. 6A shows design values concerning ink landing in this embodiment. It is assumed that sixteen ink droplets can be discharged in the overlapping section from each of the head chips 20. It is also assumed that the ink-droplet landing interval outside the overlapping sections of both the head chips 20 is 42.3 μm.

The landing interval in the upper overlapping section in the figure is set at 43.6 μm which is 1.3 μm longer than the landing interval outside the overlapping section, and the landing interval in the lower overlapping section is set at 41.0 μm which is 1.3 μm shorter than the landing interval outside the overlapping section.

While these values slightly vary according to the positional accuracy of the nozzles 21 and the heaters 22 in an actual device, they are substantially close to the design values because the accuracy of the adjoining discharging portions 30 in the same head chip 20 is very high. Since the positional accuracy thereof greatly differs between the chips 20, the landing positions are offset from each another.

FIG. 6B shows an example in which the relative difference in landing position between one head chip 20 and the other head chip 20 is 0 μm. In this case, the landing interval in the printing direction between the eighth ink droplet from the left in the upper overlapping section and the ninth ink droplet from the left in the lower overlapping section is 42.3 μm. That is, the landing interval is equal to the landing interval outside the overlapping section. Therefore, by switching the discharging of ink droplets from one head chip 20 to the other head chip 20 at that position, the boundary between the head chips 20 can be made unnoticeable.

FIG. 6C shows an example in which the relative difference in landing position between one head chip 20 and the other head chip 20 is +13 μm.

Referring again to FIG. 2, a description will be given. In FIG. 2, it is assumed that the relative difference in landing position between one head chip 20 and the other head chip 20 is β. In this case, when the first to K-th ink droplets from the left are discharged in the upper overlapping section in the figure, the K+1-th and subsequent ink droplets from the left are discharged in the lower overlapping section, and the landing interval between one head chip 20 and the other head chip 20 is closest to the landing interval L outside the overlapping section, the distance from the position A to the switching position in the upper overlapping section is given by (L+α)×K. The distance from the position A to the switching position in the lower overlapping section is given by L2+β−(L−α)×(N−K). Since it is satisfactory as long as the difference therebetween is L, L2+β−(L−α)×(N−K)−(L+α)×K=L.

With the substitution L2=L×(N+1):

$$K=(\alpha\times N+\beta)/(2\times\alpha) \qquad \text{(Equation 1)}$$

Consequently, in a case in which the relative difference in landing position is +13 μm, as shown in FIG. 6C, when α=1.3 μm, N=16, and β=13 μm are substituted in the above Equation 1, K equals 13.

Therefore, in the example shown in FIG. 6C, when the first to thirteenth ink droplets from the left are discharged in the upper overlapping section, and the fourteenth and subsequent ink droplets from the left are discharged in the lower overlapping section, the ink-droplet landing interval in the printing direction at the switching position is 42.3 μm. Accordingly, by switching the discharging of ink droplets from one head chip 20 to the other head chip 20 at that position, the boundary between the head chips 20 can be made unnoticeable.

FIG. 6D shows an example in which the relative difference in landing position between one head chip 20 and the other head chip 20 is −8 μm. In this case, when the above Equation 1 is used, K is approximately equal to 4.9.

Therefore, in the example shown in FIG. 6D, when the first to fifth ink droplets from the left are discharged in the upper overlapping section, and the sixth and subsequent ink droplets from the left are discharged in the lower overlapping section, the ink-droplet landing interval in the printing direction at the switching position is 42.1 μm. This value is closest to 42.3 μm which is the landing interval outside the overlapping section.

FIG. 6E shows an example in which the relative difference in landing position between one head chip 20 and the other head chip 20 is +30 μm.

The above Equation 1 will now be reviewed. When the value K is less than or equal to the number N of the discharging portions 30 in the overlapping section, it is possible to cope with the relative difference in landing position between one head chip 20 and the other head chip 20. That is:

$$K\leq N \qquad \text{(Equation 2)}$$

Therefore, when the relative difference β in landing position is less than or equal to 20.8 (μm), it is possible to cope with the relative difference. In actuality, K can be equal to N as long as β is approximately 21.2 (μm).

In the example shown in FIG. 6E, however, since the relative difference in landing position is +30 μm, it is impossible to cope with as in FIGS. 6B to 6D.

When discharging of ink droplets in the lower overlapping section is shifted by one dot, it is possible to consider that the relative difference in landing position of +30 μm is −12.3 μm. Therefore, when the first to K-th ink droplets from the left are discharged in the upper head chip 20, and the K-th and subsequent ink droplets from the left are discharged in the lower head chip 20, the distance from the position A to the switching position in the upper overlapping position is given by (L+α)×K. The distance from the position A to the switching position in the lower overlapping section is given by L2+β−(L−α)×(N−K+1). Since it is satisfactory as long as the difference therebetween is L:

$$L2+\beta-(L-\alpha)\times(N-K+1)-(L+\alpha)\times K=L$$

With the substitution L2=L×(N+1):

$$K=(\alpha\times(N+1)-L+\beta)/(2\times\alpha) \qquad \text{(Equation 3)}$$

When α=1.3 μm, L=42.3 μm, β=30 μm, and N=16 are substituted, K is approximately equal to 3.77.

Accordingly, in the example shown in FIG. 6E, when the first to fourth ink droplets from the left are discharged in the upper overlapping section, and the fourth and subsequent ink droplets from the left are discharged in the lower overlapping section, the ink-droplet landing interval in the printing direction at the switching position can be 41.7 μm.

In this case, the number of ink droplets landing in the overlapping section increases by one to seventeen.

Therefore, it is necessary to give discharging data to the discharging portions 30 while sequentially shifting the data, when discharging ink droplets from the lower head chip 20.

FIGS. 7A to 7E explain a second embodiment of switching the landing of ink droplets between the head chips 20, respectively, corresponding to FIGS. 6A to 6E.

In the examples shown in FIGS. 7A to 7E, the gap from the leading end of the discharging portion 30 to the printing surface is shorter than in FIGS. 6A to 6E. For example, when the gap is 2 mm in the examples shown in FIGS. 6A to 6E, it is halved to 1 mm in the examples shown in FIGS. 7A to 7E. In other words, the gap from the leading end of the discharging portion 30 to the printing surface is reduced by half while the same head as in the examples shown in FIGS. 6A to 6E is used.

In this case, since the landing interval is changed by placing the center positions of the nozzle 21 and the heater 22 offset from each other, when the gap between the leading end of the discharging portion 30 and the printing surface is halved, the amount of change in the interval is also halved. Therefore, while the ink-droplet landing interval outside the overlapping section is 42.3 μm, which is similar to that in the examples shown in FIG. 6, the landing interval in the upper overlapping section in the figure is 0.65 μm longer than the landing interval outside the overlapping section (landing interval 42.95 μm), and is half the value in FIGS. 6A to 6E. Similarly, the landing interval in the lower overlapping section in the figure is 41.65 μm, which is 0.65 μm shorter than the landing interval outside the overlapping section.

Figures 7A, 7B, 7C, 7D, 7E:
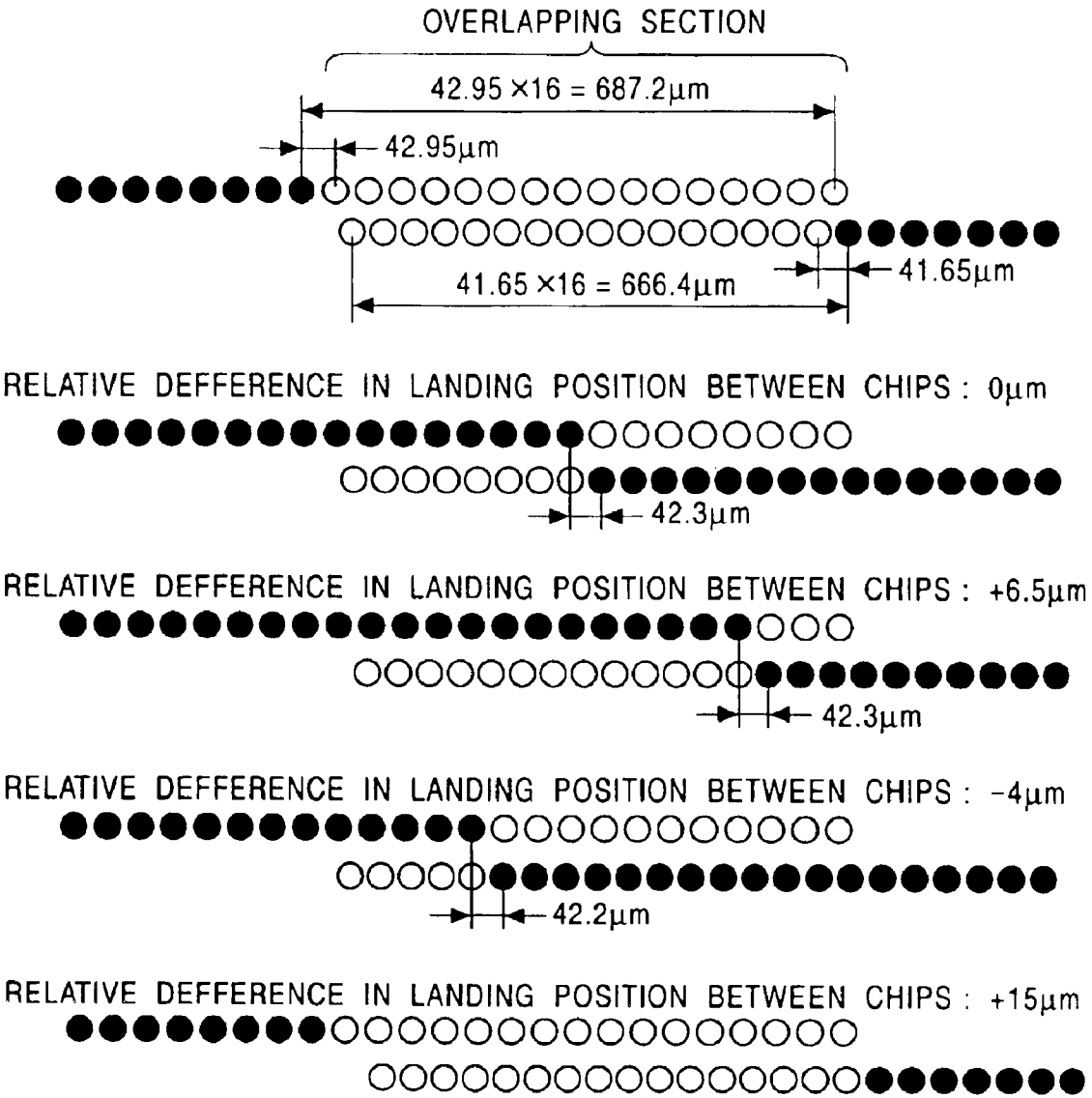
FIGS. 7A to 7E are views explaining a second embodiment of the switching the discharging of the ink droplets between the head chips.

FIG. 7B shows an example in which the relative difference in landing position is 0 μm, in a manner similar to that in FIG. 6B. In this case, the landing interval in the printing direction between the eighth ink droplet from the left in the upper overlapping section and the ninth ink droplet from the left in the lower overlapping section is 42.3 μm. Therefore, by switching the discharging of ink droplets from one head chip 20 to the other head chip 20 at that position, the boundary between the head chips 20 can be made unnoticeable.

FIG. 7C shows an example in which the relative difference in landing position between one head chip 20 and the other head chip 20 is +6.5 μm. In a case in which the relative difference in landing position is made due to the misalignment of the nozzle 21 and the heater 22, when the gap from the leading end of the discharging portion 30 to the printing surface is halved, the relative difference in the landing position is also halved. This is obvious from the description with reference to FIG. 5. That is, while the relative difference in landing position is +13 μm in FIG. 6C, it is halved to +6.5 μm in FIG. 7C. By substituting these values into Equation 1, K equals 13. Consequently, in this case, the boundary between the head chips 20 can also be made unnoticeable by switching the discharging of ink droplets from one head chip 20 to the other head chip 20 at the same position as in FIG. 6C.

FIG. 7D shows an example in which the relative difference in landing position is −4 μm. In this example, the relative difference in landing position of −8 μm in FIG. 6D is halved to −4 μm, in a manner similar to the above. By substituting these values into Equation 1, K is approximately equal to 4.9.

Consequently, in this case, the boundary between the head chips 20 can also be made unnoticeable by switching the discharging of ink droplets from one head chip 20 to the other head chip 20 at the same position as in FIG. 6D.

In an example shown in FIG. 7E, the relative difference in landing position of +30 μm in FIG. 6E is halved to +15 μm.

In the example shown in FIG. 6E, while discharging cannot be switched when sixteen ink droplets are discharged in the overlapping section of each head chip 20, switching can be made possible by setting the number of ink droplets to be discharged in the overlapping section to seventeen, and by discharging ink droplets in the lower head chips 20 while sequentially shifting discharging data to be given to the discharging portions 30.

However, when the gap is 1 mm, the relative difference in landing position between the head chips 20 is +15 μm, and the total number of ink droplets is sixteen, discharging cannot be switched. That is, K is approximately equal to 19.5 according to the above Equations 1 and 2, and the condition $K \leqq N$ is not satisfied. Further, it is impossible to cope with as in FIG. 6E.

In this way, when the gap from the leading end of the discharging portion 30 to the printing surface changes, it is sometimes impossible to cope therewith.

FIGS. 8A to 8E explain a third embodiment of switching the discharging of ink droplets from the head chips 20, respectively, corresponding to FIGS. 6A to 6E and 7A to 7E.

In the examples shown in FIGS. 8A to 8E, the gap from the leading end of the discharging portion 30 to the printing surface is longer than that in FIGS. 6A to 6E. When it is assumed that the gap is 2 mm in the examples shown in FIGS. 6A to 6E, the gap is increased to 3 mm in the examples shown in FIGS. 8A to 8E. Since the landing interval is changed by placing the center positions of the nozzle 21 and the heater 22 offset from each other in this head, when the gap from the leading end of the discharging portion 30 to the printing surface is multiplied by 1.5, the amount of change in landing interval is also multiplied by 1.5.

Therefore, while the ink landing interval outside the overlapping section is 42.3 μm which is similar to that in the examples shown in FIGS. 6A to 6E, the landing interval in the upper overlapping section in the figures is 1.95 μm longer than the landing interval outside the overlapping section (landing interval 44.25 μm), and the landing interval in the lower overlapping section is 1.95 μm shorter (landing interval 40.35 μm).

Figure 8A:
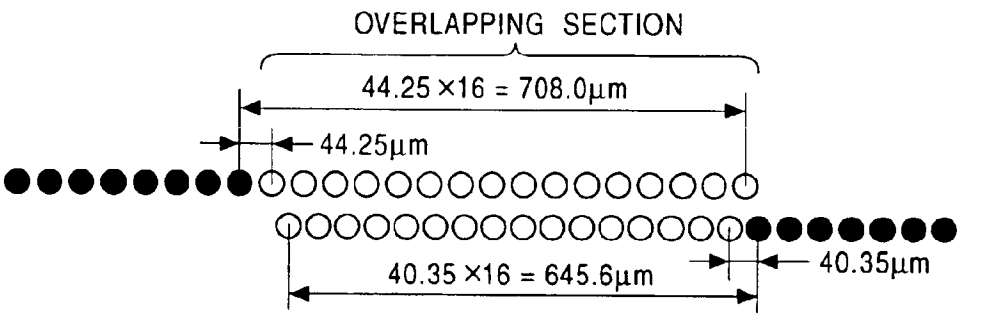
FIGS. 8A to 8E are views explaining a third embodiment of the switching the discharging of the ink droplets between the head chips.
Figure 8B:
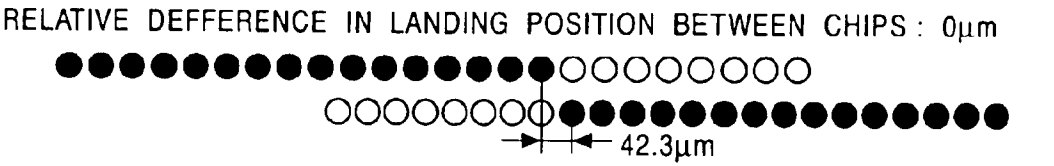

FIG. 8B shows an example in which the relative difference in landing position is 0 μm. In this case, the boundary between the head chips 20 can be made unnoticeable by switching the discharging of ink droplets from one head chip 20 to the other head chip 20 at the same position as shown in FIG. 6B.

Figure 8C:
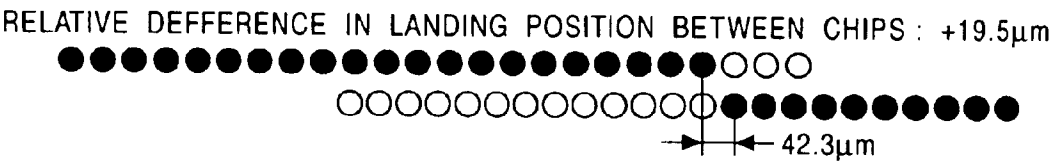

FIG. 8C shows an example in which the relative difference in landing position is +19.5 μm. This is also because the relative difference in landing position is 1.5 times the relative difference in landing position of +13 μm in FIG. 6C when it is caused by the misalignment of the nozzle 21 and the heater 22. In this case, the boundary between the head chips 20 can also be made unnoticeable by switching the discharging of ink droplets from one head chip 20 to the other head chip 20 at the same position as in FIG. 6C.

Figure 8D:
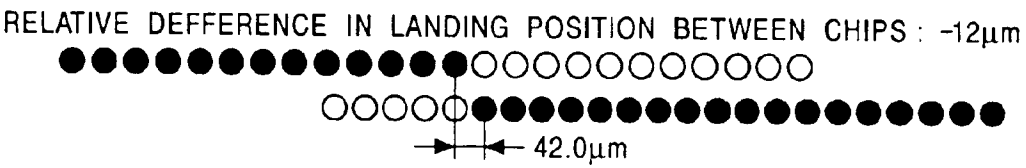

FIG. 8D shows an example in which the relative difference in landing position is −12 μm. In this example, the relative difference in landing position is 1.5 times the relative difference in landing position of −8 μm in FIG. 6D, in a manner similar to the above.

Therefore, in this case, the boundary between the head chips 20 can also be made unnoticeable by switching the discharging of ink droplets from one head chip 20 to the other head chip 20 at the same position as in FIG. 6D.

Figure 8E:
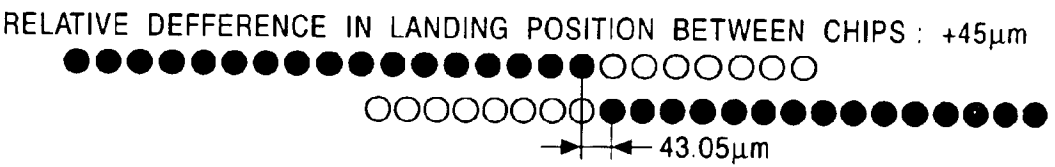

In an example shown in FIG. 8E, the relative difference in landing position is +45 μm which is 1.5 times the relative difference in landing position of +30 μm in FIG. 6E. In this example, K is approximately equal to 19.5 according to Equations 1 and 2, in a manner similar to that in FIG. 6E, and the condition K≦N is not satisfied.

However, when landing of ink droplets in the lower overlapping section is shifted by one dot, in a manner similar to that in FIG. 6E, it is possible to consider that the relative difference in landing position of +45 μm is +2.7 μm. In this case, K is approximately equal to 9.19 from Equation 3.

Accordingly, in the example shown in FIG. 8E, the landing interval in the printing direction between ink droplets can be made 43.05 μm at the switching position by discharging the first to ninth ink droplets from the left in the upper overlapping section and discharging the ninth and subsequent ink droplets from the left in the lower overlapping section.

In this case, the number of ink droplets landing in the overlapping section increases by one to seventeen, in a manner similar to that in FIG. 6E. Therefore, it is necessary to discharge ink droplets in the lower head chip 20 while sequentially shifting discharging data to be given to the discharging portions 30. As a result, switching between the head chips 20 is made at a different position from that in FIG. 6E.

FIGS. 9A to 9E explain a fourth embodiment of switching the landing of ink droplets in the head chips 20. In FIGS. 9A to 9E, ink droplets on the upper side are discharged from the overlapping section of one head chip 20, and ink droplets on the lower side are discharged from the overlapping section of the other head chip 20.

In FIG. 9, the ink-droplet landing interval in the overlapping section is changed by changing the interval between the nozzles 21 and the interval between the heaters 22 by the same length in the overlapping section, as shown in FIG. 5B. The gap from the leading end of the discharging portion 30 and the printing surface is 1 mm.

Figure 9A:
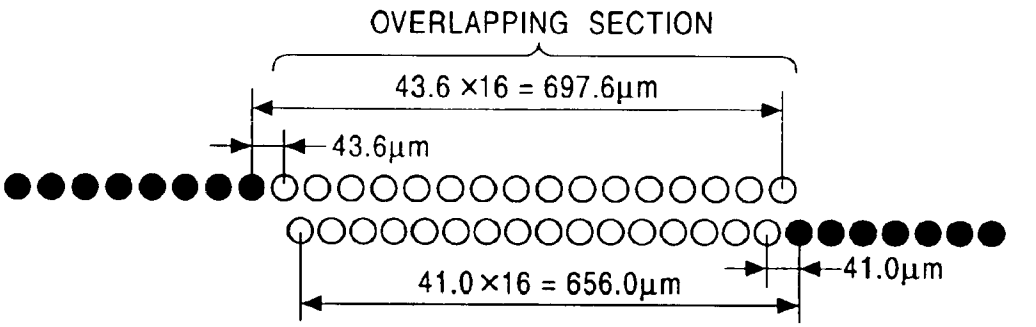
FIGS. 9A to 9E are views explaining a fourth embodiment of the switching the discharging of the ink droplets between the head chips.

FIG. 9A shows design values regarding ink landing in this example. It is assumed that sixteen ink droplets can be discharged in the overlapping section of each head chip 20, in a manner similar to those in the examples shown in FIGS. 6 to 8. The ink-droplet landing interval outside the overlapping sections of both the head chips 20 is 42.3 μm.

The ink-droplet landing interval in the upper overlapping section in the figure is set at 43.6 μm which is 1.3 μm longer than the landing interval outside the overlapping section. The ink-droplet landing interval in the lower overlapping section is set at 41.0 μm which is 1.3 μm shorter than the landing interval outside the overlapping section.

While these values slightly vary according to the positional accuracy of the nozzles 21 and the heaters 22 in an actual device, they are substantially close to the design values because the accuracy of the adjoining discharging portions 30 in the same head chip 20 is very high. Since the positional accuracy thereof greatly differs between the chips 20, the landing positions are offset from each another.

Figure 9B:
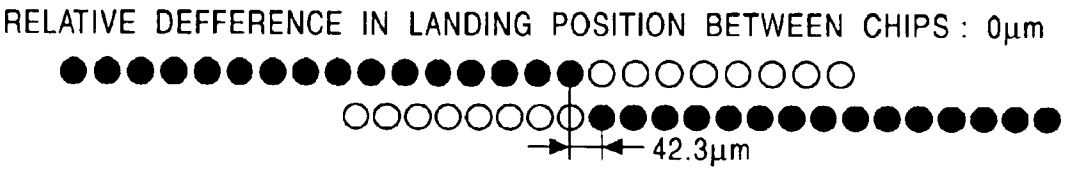

FIG. 9B shows an example in which the relative difference in landing position between one head chip 20 and the other head chip 20 is 0 μm. In this case, the landing interval in the printing direction between the eighth ink droplet from the left in the upper overlapping section and the ninth ink droplet from the left in the lower overlapping section is 42.3 μm. That is, the landing interval is equal to the landing interval outside the overlapping section. Therefore, the boundary between the head chips 20 can be made unnoticeable by switching the discharging of ink droplets from one head chip 20 to the other head chip 20 at that position.

Figure 9C:
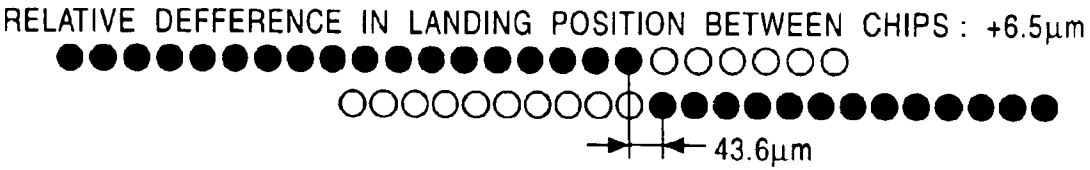

FIG. 9C shows an example in which the relative difference in landing position between one head chip 20 and the other head chip 20 is +6.5 μm. In this case, K is equal to 10.5 from Equation 1. Therefore, the landing interval in the printing direction between the tenth ink droplet from the left in the upper overlapping section and the eleventh ink droplet from the left in the lower overlapping section is 43.6 μm. Accordingly, the boundary between the head chips 20 can be made unnoticeable by switching the discharging of ink droplets from one head chip 20 to the other head chip 20 at that position.

Figure 9D:
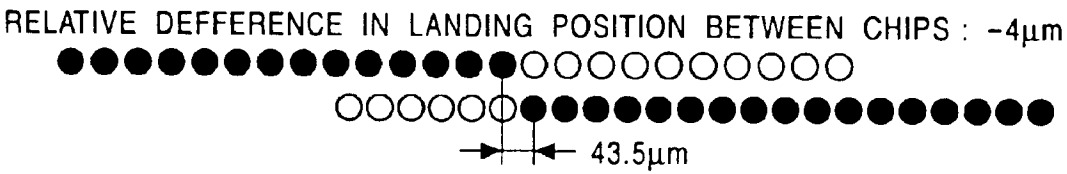

FIG. 9D shows an example in which the relative difference in landing position between one head chip 20 and the other head chip 20 is −4 μm. In this case, K is approximately equal to 6.46 from Equation 1. Therefore, the landing interval in the printing direction between the sixth ink droplet from the left in the upper overlapping section and the seventh ink droplet from the left in the lower overlapping section is 43.5 μm. Accordingly, the boundary between the head chips 20 can be made unnoticeable by switching the discharging of ink droplets from one head chip 20 to the other head chip 20 at that position.

Figure 9E:
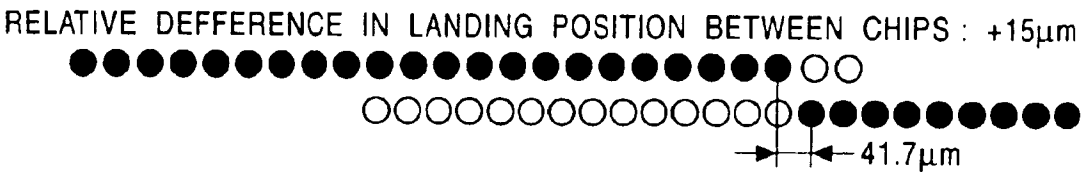

FIG. 9E shows an example in which the relative difference in landing position between one head chip 20 and the other head chip 20 is +15 μm. In this case, K is approximately equal to 13.8 from Equation 1. Therefore, the landing interval in the printing direction between the fourteenth ink droplet from the left in the upper overlapping section and the fifteenth ink droplet from the left in the lower overlapping section is 41.7 μm. Accordingly, the boundary between the head chips 20 can be made unnoticeable by switching the discharging of ink droplets from one head chip 20 to the other head chip 20 at that position.

While it is impossible to respond to the switching of discharging in the example shown in FIG. 7E when the relative difference in landing position is +15 μm, even when the gap is the same and the relative difference in landing position is the same, it is possible to respond to the switching in the example shown in FIG. 9E.

In such a case in which the ink-droplet landing interval in the overlapping section is changed by changing the interval between the nozzles 21 and the interval of the heaters 22 by the same length, as shown in FIGS. 9A to 9E, when mounting errors of the nozzle sheet 26 and the heater 22 occur, the discharging angle of ink droplets varies. Therefore, when the gap changes in this case, the relative difference in landing position between the head chips 20 varies depending on the gap. Accordingly, when the gap changes, it is necessary to change the switching position where discharging of ink droplets should be switched from one head chip 20 to the other head chip 20.

According to the above, when the interval between the nozzles 21 and the interval between the heaters 22 are different from each other in the overlapping sections of the head chips 20, it is sometimes impossible to cope with the relative difference in landing position between the head chips 20. When the relative difference in landing position is caused by the misalignment between the nozzle 21 and the heater 22, the position where the discharging of ink droplets is switched does not vary depending on changes in gap.

On the other hand, when the relative difference in position is caused by the displacement of the discharging portion 30 itself (when not caused by the shift of the discharging angle), it is necessary to change the discharging switching position in accordance with changes in gap.

In contrast, in a case in which the interval between the nozzles 21 and the interval between the heaters 22 are changed by the same length, when the relative difference in landing position is caused by the misalignment of the nozzle 21 and the heater 22, the switching position of discharging of ink droplets varies with the gap. This brings the advantage that it is possible to cope with a large difference in landing position between the head chips 20. Moreover, even when the relative difference in landing position is caused by the displacement of the discharging portion 30 itself (when not caused by the shift of the discharging angle), the discharging switching position does not vary depending on changes in gap.

Figure 10A:
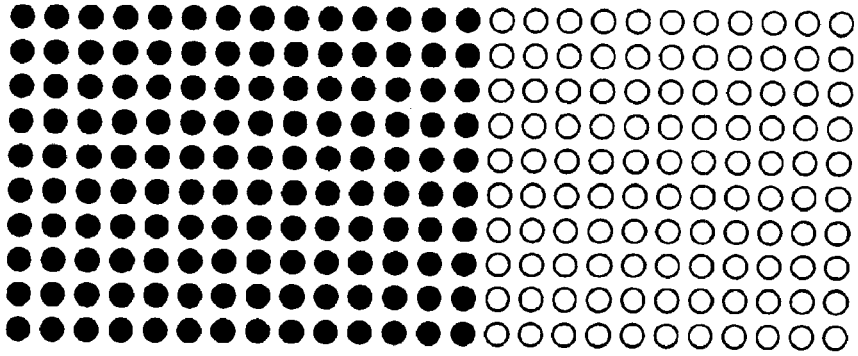
FIGS. 10A to 10C are views showing examples of dots printed while switching the discharging between two head chips.
Figure 10B:
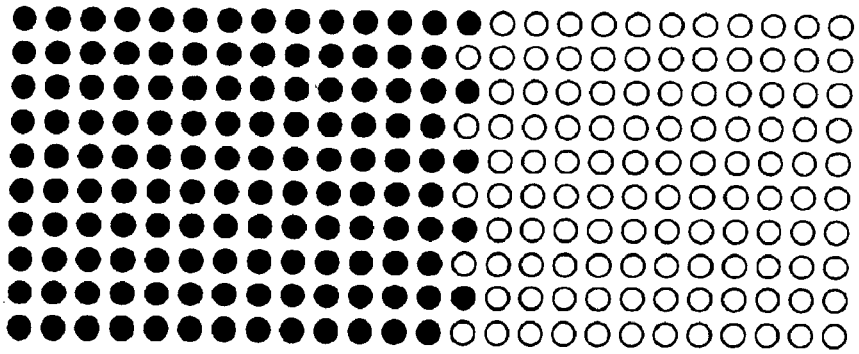
Figure 10C:
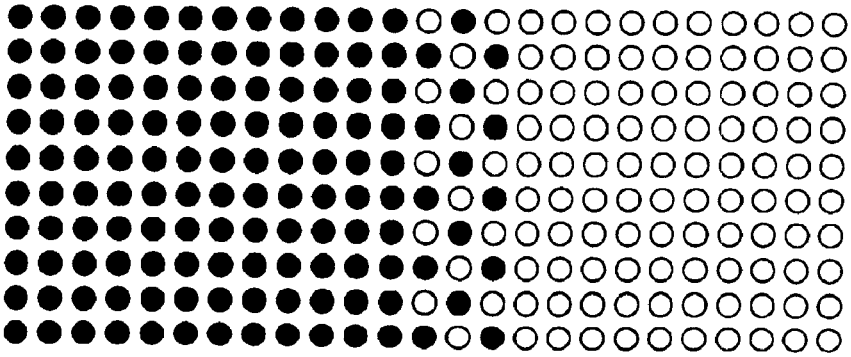
Figure 11:
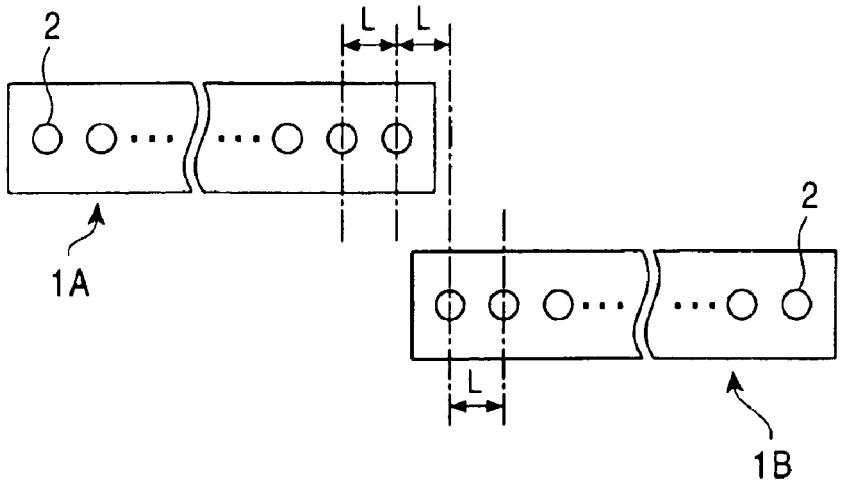
FIG. 11 is a view showing an example of a printer head in a known thermal ink-jet line printer.
Figure 12A:
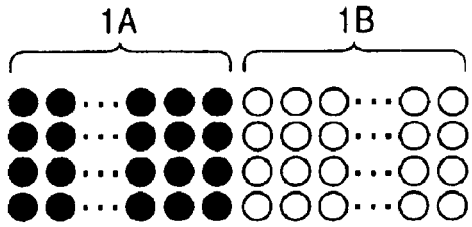
FIGS. 12A to 12C are views showing a state in which ink droplets are discharged onto a printing object.
Figure 12B:
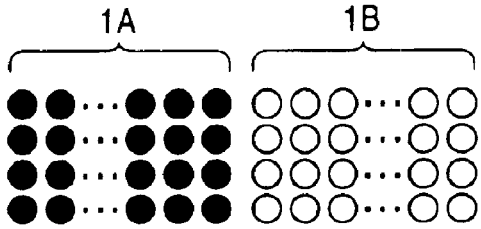
Figure 12C:
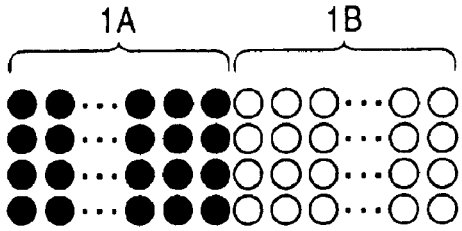

FIGS. 10A, 10B, and 10C show examples in which printing is performed with two head chips 20 while making switching therebetween. In FIGS. 10A to 10C, black circles represent printed ink droplets from one head chip 20, and white circles represent printed ink droplets from the other head chip 20. FIG. 10A shows an example in which discharging is switched at the switching position between the head chips 20 in accordance with the relative difference in landing position.

As shown in FIGS. 10B and 10C, ink droplets may be alternately discharged for several dots on the right and left sides of the switching position between the head chips 20. In the example shown in FIG. 10B, the switching position is shifted by one dot in each line. In the example shown in FIG. 10C, the switching position is changed in each line, and an ink droplet at the end of the overlapping section of one head chip 20 exists between ink droplets at the end of the overlapping section of the other head chip 20.

When there is a difference in discharging amount of ink droplets and the like between two head chips 20, this can make the change gradual.

The printer head is provided with a discharging-portion information storage means (memory) for storing information about which of the discharging portions 30 of each head chip 20 are used for printing, that is, information about how many discharging portions 30 from the first of the overlapping section are used, and what number of discharging portion 30 in the overlapping section of the other head chip 20 is first used, and as necessary, information about how the discharging data is shifted. During printing, information, stored in the discharging-portion information storage means, about the discharging portions 30 to be used for printing is read by a discharging-portion information reading means, and discharging of ink droplets in the overlapping sections is controlled by a discharging control means according to the read information.

While the present invention has been described above with reference to one embodiment, the invention is not limited to the above-described embodiment, and the following various modifications are possible.

(1) The values described in the embodiment are examples, and the present invention is not limited to the values in the embodiment. For example, it is possible to arbitrarily determine whether a difference of the ink-droplet landing interval in the overlapping section from that outside the overlapping section is, for example, ±0.5 μm, ±1.0 μm, or ±2.0 μm, depending on the output characteristics of the heaters 22, the characteristics of ink, and the like.

(2) In this embodiment, the ink-droplet landing interval in one of the overlapping sections is longer than the landing interval outside the overlapping section, and is shorter in the other overlapping section than the landing interval outside the overlapping section. For example, the ink-droplet landing interval in one of the overlapping sections may be equal to that outside the overlapping section, and the ink-droplet landing interval in the other overlapping section may be longer or shorter than the landing interval outside the overlapping section. The landing intervals need not necessarily be increased and decreased by the same amount.

(3) While the number of printed ink droplets in the overlapping section of each head chip 20 is sixteen in this embodiment, the number may be set at any value.

(4) While the ink-droplet landing interval in the overlapping section of each head chip 20 is fixed, it need not be fixed. For example, the interval may increase or decrease at a fixed increasing or decreasing rate. The ink-droplet landing interval may gradually increase or decrease several dots before the overlapping section without being suddenly changed at the beginning of the overlapping section. This can more naturally change the landing interval.

(5) While the single-color printer head 10 has been described as an example in this embodiment, the present invention can be adapted to a multicolor (for example, four colors of cyan, magenta, yellow, and black) printer head by preparing printer heads corresponding the respective colors and arranging the printer heads in the printing direction.

What is claimed is:

1. A printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

2. A printer head according to claim 1, wherein the interval between nozzles of said discharging portions in said overlapping section of said first head chip and the interval between nozzles of said discharging portions in said overlapping section of said second head chip are different from each other.

3. A printer head according to claim 1, wherein the interval between heaters of said discharging portions in said overlapping section of said first head chip and the interval between heaters of said discharging portions in said overlapping section of said second head chip are different from each other.

4. A printer head according to claim 1, wherein the landing interval between ink droplets discharged from said discharging portions in said overlapping section is more than the landing interval between ink droplets discharged from said discharging portions outside said overlapping section in one of said first head chip and said second head chip, and the landing interval between ink droplets discharged from said discharging portions in said overlapping section is less than the landing interval between ink droplets discharged from said discharging portions outside said overlapping section in the other head chip.

5. A printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section;

the an interval between nozzles of said discharging portions in said overlapping section of said first head chip and the interval between nozzles of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

6. A printer head according to claim 5, wherein the interval between heaters of said discharging portions in said overlapping section of said first head chip and the interval between heaters of said discharging portions in said overlapping section of said second head chip are different from each other.

7. A printer head according to claim 5, wherein the landing interval between ink droplets discharged from said discharging portions in said overlapping section is more than the landing interval between ink droplets discharged from said discharging portions outside said overlapping section in one of said first head chip and said second head chip, and the landing interval between ink droplets discharged from said discharging portions in said overlapping section is less than the landing interval between ink droplets discharged from said discharging portions outside said overlapping section in the other head chip.

8. A printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section;

an interval between nozzles of said discharging portions in said overlapping section of said first head chip and the interval between nozzles of said discharging portions in said overlapping section of said second head chip are different from each other;

an interval between heaters of said discharging portions in said overlapping section of said first head chip and the interval between heaters of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

9. A printer head according to claim 8, wherein the landing interval between ink droplets discharged from said discharging portions in said overlapping section is more than the landing interval between ink droplets discharged from said discharging portions outside said overlapping section in one of said first head chip and said second head chip, and the landing interval between ink droplets discharged from said discharging portions in said overlapping section is less than the landing interval between ink droplets discharged from said discharging portions outside said overlapping section in the other head chip.

10. A printer head comprises:

a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

11. A printer head according to claim 10, wherein the interval between nozzles of said discharging portions in said overlapping section of said first head chip and the interval between nozzles of said discharging portions in said overlapping section of said second head chip are different from each other.

12. A printer head according to claim 10, wherein the interval between heaters of said discharging portions in said overlapping section of said first head chip and the interval between heaters of said discharging portions in said overlapping section of said second head chip are different from each other.

13. A printer head according to claim 10, wherein the landing interval between ink droplets discharged from said discharging portions in said overlapping section is more than the landing interval between ink droplets discharged from said discharging portions outside said overlapping section in one of said first head chip and said second head chip, and the landing interval between ink droplets discharged from said discharging portions in said overlapping section is less than the landing interval between ink droplets discharged from said discharging portions outside said overlapping section in the other head chip.

14. A printer comprising:

a printer head;

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

15. A printer comprises:

a printer head;

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section;

an interval between nozzles of said discharging portions in said overlapping section of said first head chip and the interval between nozzles of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

16. A printer comprises:

a printer head;

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section;

an interval between nozzles of said discharging portions in said overlapping section of said first head chip and the interval between nozzles of said discharging portions in said overlapping section of said second head chip are different from each other;

an interval between heaters of said discharging portions in said overlapping section of said first head chip and the interval between heaters of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

17. A printer comprises:

a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

18. A driving method for a printer head printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section;

the landing interval between ink droplets discharged from said discharging portions in said overlapping section of said first head chip and the landing interval between ink droplets discharged from said discharging portions in said overlapping section of said second head chip are different from each other; and and said first head chip and said second head chip are driven so as to switch the discharging of ink droplets from said discharging portions of said first head chip to the discharging of ink droplets from said discharging portions of said second head chip at a position where the interval between the landing position of an ink droplet from a specific discharging portion of said first head chip and the landing position of an ink droplet from a specific discharging portion of said second head chip is closest to the interval in the printing line direction between landing positions of ink droplets from said discharging portions outside said overlapping section of said first head chip or said second head chip.

19. A printer-head driving method according to claim 15, wherein said first head chip and said second head chip are driven so as to switch the discharging of ink droplets from said discharging portions of said first head chip to the discharging of ink droplets from said discharging portions of said second head chip at a position where the interval in the printing line direction between the landing position of an ink droplet from a specific discharging portion of said first head chip and the landing position of an ink droplet from a specific discharging portion of said second head chip is closest to the interval in the printing line direction between the landing positions of ink droplets from said discharging portions outside said overlapping section of said first head chip or said second head chip when discharging of ink droplets is shifted by at least one discharging portion in said discharging portions in said overlapping section of one of said first head chip and said second head chip, and so as to shift discharging data on ink droplets from said discharging portions in said overlapping section of one of said first head chip and said second head chip by at least one discharging portion.

20. A printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

21. A printer head according to claim 20, wherein the interval between nozzles of said discharging portions in said overlapping section of said first head chip and the interval between nozzles of said discharging portions in said overlapping section of said second head chip are different from each other.

22. A printer head according to claim 20, wherein the interval between heaters of said discharging portions in said overlapping section of said first head chip and the interval between heaters of said discharging portions in said overlapping section of said second head chip are different from each other.

23. A printer head according to claim 20, wherein the landing interval between ink droplets discharged from said discharging portions in said overlapping section is more than the landing interval between ink droplets discharged from said discharging portions outside said overlapping section in one of said first head chip and said second head chip, and the landing interval between ink droplets discharged from said discharging portions in said overlapping section is less than the landing interval between ink droplets discharged from said discharging portions outside said overlapping section in the other head chip.

24. A printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

25. A printer head according to claim 24, wherein the interval between heaters of said discharging portions in said overlapping section of said first head chip and the interval between heaters of said discharging portions in said overlapping section of said second head chip are different from each other.

26. A printer head according to claim 24, wherein the landing interval between ink droplets discharged from said discharging portions in said overlapping section is more than the landing interval between ink droplets discharged from said discharging portions outside said overlapping section in one of said first head chip and said second head chip, and the landing interval between ink droplets discharged from said discharging portions in said overlapping section is less than the landing interval between ink droplets discharged from said discharging portions outside said overlapping section in the other head chip.

27. A printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and an interval between nozzles of said discharging portions in said overlapping section of said first head chip and the interval between nozzles of said discharging portions in said overlapping section of said second head chip are different from each other an interval between heaters of said discharging portions in said overlapping section of said first head chip and the interval between heaters of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

28. A printer head according to claim 27, wherein the landing interval between ink droplets discharged from said discharging portions in said overlapping section is more than the landing interval between ink droplets discharged from said discharging portions outside said overlapping section in one of said first head chip and said second head chip, and the landing interval between ink droplets discharged from said discharging portions in said overlapping section is less than the landing interval between ink droplets discharged from said discharging portions outside said overlapping section in the other head chip.

29. A printer head comprises:

a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

30. A printer head according to claim 29, wherein the interval between nozzles of said discharging portions in said overlapping section of said first head chip and the interval between nozzles of said discharging portions in said overlapping section of said second head chip are different from each other.

31. A printer head according to claim 29, wherein the interval between heaters of said discharging portions in said overlapping section of said first head chip and the interval between heaters of said discharging portions in said overlapping section of said second head chip are different from each other.

32. A printer head according to claim 29, wherein the landing interval between ink droplets discharged from said discharging portions in said overlapping section is more than the landing interval between ink droplets discharged from said discharging portions outside said overlapping section in one of said first head chip and said second head chip, and the landing interval between ink droplets discharged from said discharging portions in said overlapping section is less than the landing interval between ink droplets discharged from said discharging portions outside said overlapping section in the other head chip.

33. A printer comprises:

a printer head;

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

34. A printer comprises:

a printer head;

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and an interval between nozzles of said discharging portions in said overlapping section of said first head chip and the interval between nozzles of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

35. A printer comprises:

a printer head;

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and an interval between nozzles of said discharging portions in said overlapping section of said first head chip and the interval between nozzles of said discharging portions in said overlapping section of said second head chip are different from each other.

an interval between heaters of said discharging portions in said overlapping section of said first head chip and the interval between heaters of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

36. A printer comprises:

a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and the landing interval between ink droplets discharged from said discharging portions in said overlapping section of said first head chip and the landing interval between ink droplets discharged from said discharging portions in said overlapping section of said second head chip are different from each other.

37. A driving method for a printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section;

the landing interval between ink droplets discharged from said discharging portions in said overlapping section of said first head chip and the landing interval between ink droplets discharged from said discharging portions in said overlapping section of said second head chip are different from each other; and and said first head chip and said second head chip are driven so as to switch the discharging of ink droplets from said discharging portions of said first head chip to the discharging of ink droplets from said discharging portions of said second head chip at a position where the interval between the landing position of an ink droplet from a specific discharging portion of said first head chip and the landing position of an ink droplet from a specific discharging portion of said second head chip is closest to the interval in the printing line direction between landing positions of ink droplets from said discharging portions outside said overlapping section of said first head chip or said second head chip.

38. A printer-head driving method according to claim 37, wherein said first head chip and said second head chip are driven so as to switch the discharging of ink droplets from said discharging portions of said first head chip to the discharging of ink droplets from said discharging portions of said second head chip at a position where the interval in the printing line direction between the landing position of an ink droplet from a specific discharging portion of said first head chip and the landing position of an ink droplet from a specific discharging portion of said second head chip is closest to the interval in the printing line direction between the landing positions of ink droplets from said discharging portions outside said overlapping section of said first head chip or said second head chip when discharging of ink droplets is shifted by at least one discharging portion in said discharging portions in said overlapping section of one of said first head chip and said second head chip, and so as to shift discharging data on ink droplets from said discharging portions in said overlapping section of one of said first head chip and said second head chip by at least one discharging portion.

39. A printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between nozzles of said first head chip and said second head chip is equally set in an overlapping section and outside said overlapping section;

an interval between heaters of said discharging portions in said overlapping section of said first head chip and the interval between heaters of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

40. A printer head comprising:

a line head; and a plurality of head chips arranged side by side in a printing line direction, and each having a plurality of discharging portions aligned in the printing line direction so as to discharge an ink droplet, wherein, a plurality of discharging portions of a first head chip and a second head chip placed at an adjoining portion therebetween are placed so as to overlap;

an interval between heaters of said first head chip and said second head chip is equally set in an overlapping section and outside said overlapping section; and an interval between heaters of said discharging portions in said overlapping section of said first head chip and the interval between heaters of said discharging portions in said overlapping section of said second head chip are different from each other; and the landing interval between ink droplets discharged from said discharging portions in said overlapping section of said first head chip and the landing interval between ink droplets discharged from said discharging portions in said overlapping section of said second head chip are different from each other.

* * * * *